US005979599A

United States Patent [19]

Noles

[11] Patent Number: 5,979,599

[45] Date of Patent: Nov. 9, 1999

[54] TRACK TRANSPORT SYSTEM, TRACK-SUPPORT BRACKET, AND TRACK-TRAVELING APPARATUS

[76] Inventor: Larry J. Noles, 19 Union St., Waterbury, Vt. 05676

[21] Appl. No.: 08/767,832

[22] Filed: Dec. 17, 1996

[51] Int. Cl.[6] ..... A62B 37/00

[52] U.S. Cl. ..... 182/36; 182/3

[58] Field of Search ..... 182/36, 3; 104/53, 104/115, 116, 93

[56] References Cited

U.S. PATENT DOCUMENTS

| | | | |
|---|---|---|---|
| 2,083,218 | 6/1937 | Carter . | |
| 2,500,805 | 3/1950 | Costello | 119/29 |
| 2,620,408 | 12/1952 | Hawkes . | |
| 3,601,348 | 8/1971 | Gonsalves | 104/115 |
| 3,648,664 | 3/1972 | Nunley | 119/120 |
| 4,721,182 | 1/1988 | Brinkmann | 182/36 |
| 4,790,410 | 12/1988 | Sharp et al. | 182/36 |
| 4,862,833 | 9/1989 | Brotz | 119/120 |
| 5,279,385 | 1/1994 | Riches et al. | 182/3 |
| 5,297,651 | 3/1994 | Vandelinde | 182/36 |
| 5,316,102 | 5/1994 | Bell | 182/3 |
| 5,339,773 | 8/1994 | Van Druff | 119/785 |
| 5,343,975 | 9/1994 | Riches et al. | 182/3 |
| 5,350,037 | 9/1994 | Ghahremani | 182/3 |
| 5,361,866 | 11/1994 | Bell et al. | 182/3 |
| 5,409,195 | 4/1995 | Strickland et al. | 256/1 |
| 5,437,246 | 8/1995 | Noles . | |

FOREIGN PATENT DOCUMENTS 2458213 2/1981 France .

*Primary Examiner*—Alvin Chin-Shue
*Attorney, Agent, or Firm*—Theodore R. Touw

[57] ABSTRACT

A cable or other track is supported at points along its length by track support brackets that define and shape the course of the track, providing corners, curves, and other direction changes. A track-traveling element is provided that can travel along the track unimpeded by the track supports. The track support and the track-traveling element are formed to cooperate with each other so that the track-traveling element can pass by the track support brackets without manipulation. The track support has an arcuate arm having a center of curvature and an arm radius defining a circular segment. The track-traveling element has a passageway surrounding the track, a pivoting axis, and a slot communicating with the passageway. The slot is spaced from the pivoting axis by a distance substantially equal to the arm radius of the track support. The pivoting axis and the arcuate arm's center of curvature are arranged to be coincident within a predetermined tolerance, so that the slot passes the arcuate arm despite pivoting of the track-traveling element throughout a substantial range of angles about the pivoting axis. The system can be used for various purposes including carrying loads in a conveyor system, protection of a worker in a fall-arrest system, controlling an animal in an animal-tethering system, and supporting and guiding draperies.

27 Claims, 12 Drawing Sheets

TRACK TRANSPORT SYSTEM, TRACK-SUPPORT BRACKET, AND TRACK-TRAVELING APPARATUS

TECHNICAL FIELD

The present invention relates generally to apparatus for transport along a track. It relates more particularly to track system apparatus including a flexible and/or rigid track, supports for locally supporting a track in a spaced relation to a fixture, and a track-traveling element to which a load can be coupled and which is displaceable along the track.

BACKGROUND OF THE INVENTION

Workers who are performing duties at heights or near vertical edges need to be protected from falls that might cause injury or death. In many situations where putting up railing is not a feasible or viable option (e.g. working on top of an airplane, tractor trailer, or railroad car, as well as erecting steel and many other construction and industrial tasks), then a system has to be employed that will protect the worker.

Protection systems are in use that incorporate a lanyard attached at one end to a single fixed anchor point and to a harness or safety belt worn by the worker at the other end. This single anchor system is a safe option for performing some types of tasks, but many tasks are performed over areas larger than can be provided by a single anchor point. In this type of situation, the worker has to disconnect himself from one anchor point and reconnect to another. During the time when the worker is in the process of changing anchor points the worker becomes exposed to hazards of falling. This type of system is very limited as to the type of safe tasks a worker can perform while attached.

A system that allows more mobility than the single anchor point system is the two point system where a worker's safety belt or harness is attached to a lanyard and possibly to a shock absorber, and the other end of the lanyard is attached to a trolley, slide, or other movable component that is adapted to move freely along a track, e.g. an I-beam or cable that is supported or anchored safely at two end-points, the track usually being directly overhead in relation to the worker. Such a system is limited to a straight-line movement of the worker between the two end-points and in the case of the I-beam requires a more or less permanent installation.

There are also systems known and in use at the present time that use a non-flexible track usually constructed by connecting many smaller sections together to create one continuous track of metal or plastic rails which can form curves and corners and allow the movable component to freely travel along the entire length of the track without being impeded by track supports. These systems, because of the number of pieces of hardware required to form and install them, are usually costly to manufacture, are time-consuming to install, require many safe anchor-points to be tested, and are probably better for use as non-fall-arrest permanent installations.

Many applications and tasks could be made easier and would benefit from a multiple track-support system that allows passage of a track-traveling element past the track supports unaided by human intervention and unimpeded by undue frictional orientation of passing components. Among these applications would be fall-arrest systems, animal-tethering systems, conveyor systems, and guidance systems.

DESCRIPTION OF THE BACKGROUND ART

Designs of multiple track-support fall-arrest apparatus and animal-tethering apparatus permitting movement of a track-traveling element past a plurality of local track supports are known. U.S. Pat. No. 5,350,037 to Ghahremani (1994) describes a workperson safety restraint (fall-arrest) system having a cable extending between cable supports and a method of moving past cable supports which requires a tie element to be lifted, thus exposing a slot in the track-contact component which can then be aligned to move past the cable support. The lifting of the tie element and the alignment of the track-contact component with the cable support require the worker to physically manipulate the components.

U.S. Pat. No. 5,279,385 to Riches et al. (1994) describes another fall-arrest apparatus in which a track support locally supports an elongated cable safety track. The Riches et al. apparatus has a cable-holding bracket portion through which a track can extend and has a load-coupling component comprising a tube which can slide along the track. This apparatus has a means for attaching a load to the tube. The tube is shaped so that the head portion of the track support can pass through it, and the tube also has a longitudinal slot through which the neck of the track support, to which the head portion of the track support is attached, can pass through at the same time that the head passes through the tube. The tube is oriented to pass the track support by means of cam edges or faces at one or both ends of the tube that cause the tube to rotate from axial abutment pressure of the neck of the track-support bracket against the cam edges of the tube. The load-coupling component is constructed with a pivotal connection point where the lanyard attaches to it. This pivotal connection point allows turning motion of the slotted tube around the safety track to occur for passing a track support. U.S. Pat. No. 5,343,975 to Riches et al. (1994) describes another fall-arrest apparatus, characterized in that each of its brackets is formed so that it becomes permanently deformed if subjected to heavy loading due to a fall. Other safety restraint inventions are described in U.S. Pat. No. 4,790,410 to Sharp et al. (1988), U.S. Pat. No. 5,361,866 to Bell et al. (1994) and U.S. Pat. No. 5,409,195 to Strickland et al. (1995).

U.S. Pat. No. 3,678,903 to Ferraro (1972) and U.S. Pat. No. 3,648,664 to Nunley (1972) both show animal-tethering apparatus that have track-traveling devices that are guided past track supports by cam edges on the tube of the track supports which orient and align the components for passage, in a manner functionally similar to that of U.S. Pat. No. 5,279,385 to Riches et al., mentioned above. Other animal-tethering systems are described in U.S. Pat. No. 5,339,773 to Van Druff (1994) and U.S. Pat. No. 5,437,246 to Noles (1995).

PROBLEMS SOLVED BY THE INVENTION

Systems of the background art that require a worker to physically manipulate a component, e.g. by lifting a tie element or by aligning a track-traveling component with a support, have somewhat limited use because the worker must have at least one hand free. Some such systems cannot be used in an overhead situation because the tie element cannot pass the cable supports with a load attached. Some available systems use forced frictional orientation of a track-traveling component into a particular orientation for passing a track support. For example, they may use a cam action, in which friction at a cam surface forces the track-traveling component to be re-oriented for passing the track support. Such systems have many frictional wear points that can cause damage to movable components, difficult operation, and weakening of components. Such problems can sacrifice the integrity of such systems' fall-arrest capabilities. For example, the head and neck of a cable support can be subject to a significant amount of frictional wear as can the ends and slot of some track-traveling components, the cam edges, pivot pins, and the housings of track-traveling components that have such elements.

It is desirable to provide versatile components to be used in various types of multiple track-support systems that will allow freedom of a track's course design, will provide security of operation, and will be subject to a minimal amount of frictional wear. It is further desirable to provide components that are easy to manufacture, that are easy to install and maintain, and that allow a system to be built that can allow uninterrupted and unimpeded navigation around corners, track supports, and other obstacles. Often it is necessary to have a plurality of such track supports located at intervals along the track.

A system of this type is useful in numerous applications including but not limited to fall-arrest safety installations for protecting workers at a height, animal tethering and restraint systems, conveyor systems, guidance systems, ski lifts, hoists, drapery or curtain systems, drying supports such as clotheslines, and any other applications where it is desirable to move a load generally along a track past local track supports.

PURPOSES, OBJECTS, AND ADVANTAGES

Accordingly, several purposes, objects, and advantages of my invention are:

(a) to provide components for a fall-arrest system that protects workers at a height while allowing mobility of a worker to freely move generally along a track in a work area;

(b) to provide components for a multiple track-support system that is easy to install and maintain;

(c) to provide components for a multiple track-support system that provides a way to propel a load past anchor points without disconnecting from and reconnecting to the system;

(d) to provide a multiple track-support system that provides a way for a load to travel around corners without disconnecting from and reconnecting to the system;

(e) to provide a multiple track-support system that functions with a minimal amount of friction and wear;

(f) to provide a multiple track-support system that eliminates any requirement of manual orientation of a track-traveling element for passing a track support; and (g) to provide a multiple track-support system that eliminates forced frictional orientation of a track-traveling element for passing a track support.

Further objects and advantages are to provide components for a multiple track-support system that can be used in a wide range of applications where present systems might be difficult to use. Still further objects and advantages will become apparent from a consideration of the ensuing description and drawings or from practice of the invention.

DISCLOSURE OF INVENTION

A cable or other track is supported at points along its length by track support brackets that define and shape the course of the track, providing corners, curves, and other direction changes. A track-traveling element is provided that can travel along the track unimpeded by the track supports. The track support and the track-traveling element are formed to cooperate with each other so that the track-traveling element can pass by the track support brackets without manipulation. The track support has an arcuate arm having a center of curvature and an arm radius defining a circular segment. The track-traveling element has a passageway surrounding the track, a pivoting axis, and a slot communicating with the passageway. The slot is spaced from the pivoting axis by a distance substantially equal to the arm radius of the track support. The pivoting axis and the arcuate arm's center of curvature are arranged to be coincident within a predetermined tolerance, so that the slot passes the arcuate arm despite pivoting of the track-traveling element throughout a substantial range of angles about the pivoting axis. The system can be used for various purposes including carrying loads in a conveyor system, protection of a worker in a fall-arrest system, controlling an animal in an animal-tethering system, and supporting and guiding draperies.

Thus, in one aspect, the invention provides a track transport system including a track-support having a curvilinear arm with a center of curvature and a track-traveling element having a slot adapted to pass the curvilinear arm of the track support unimpeded, while allowing the track-traveling element to pivot freely about an axis at or near the center of curvature of the curvilinear arm. The curvilinear arm has the form of a sector of a circle with a predetermined radius centered within the track or above the axis of the track. The track-traveling element can pass the curvilinear arm while oriented throughout a useful range of angles about its pivoting axis because the distance from the pivoting axis to the slot is made equal to the radius of the curvilinear arm and the slot is made at least slightly wider than the thickness of the curvilinear arm. The slot may also be made curvilinear with the same radius of curvature as the curvilinear arm. The track-traveling element is made to have a pivoting axis that is coincident (within a predetermined tolerance) with the center of curvature of the curvilinear arm when the track-traveling element is passing the track support.

The top surface of the track itself and/or the top surface of a portion of the track support extending over the top of the track may be formed with a curved contour to facilitate pivoting of the track-traveling element. In preferred embodiments, the center of curvature of that curved contour, the pivoting axis of the track-traveling element, and the center of curvature of the curvilinear arm of the track support all coincide within predetermined tolerances when the track-traveling element is aligned with or passing the track support.

In another way of describing the invention, the track-traveling element has a passageway that generally surrounds the track while in operation, and a slot communicates between the periphery of the track-traveling element and the passageway. As the track-traveling element pivots anywhere along the track, including at the instant it passes a track support, the slot describes an imaginary cylindrical surface. Both the radius and center of curvature of the curvilinear arm of the track support are arranged so that the imaginary cylindrical surface passes through the curvilinear arm, so that the track-traveling element can pass the arm.

In another aspect of the present invention, it provides an apparatus comprising (i) a track support for locally supporting a track in spaced relation to a fixture, the support having a track-locating portion, tube, sleeve or fist (hereafter called a "fist") through which a track can extend or to which a track can abut, and (ii) a track-traveling element which can slide or roll along the track and a means whereby a load can be attached to the track-traveling element. The track-traveling element also defines a passageway which is large enough to allow passage of the fist of the track-support bracket and the fist support (hereafter called a "forearm"). The passageway is peripherally interrupted by a slot for the simultaneous passage of a portion of the arm of the track-support bracket (hereafter called an "upper-arm"). In other words, a slot extends from the passageway through the periphery of the track-traveling element for passage of the upper arm. Some terminology utilizing anatomical analogy is used in this description for clarity and a simple description, but the anatomical terms used are not intended to imply that the invention uses relative proportions, mobility or articulation properties, or any other physical properties of the corresponding human anatomy.

Otherwise defined, the track transport apparatus made in accordance with the invention is characterized in that the track-traveling element is freely pivotable relative to the track at all positions along the track. The track-traveling element may be pivoted about an axis located in the track or a suitable distance above the axis of the track. The track-traveling element may have any angular orientation in relation to the track support (subject to clearances described in more detail below), up to any limits that may be imposed by the length of a lanyard or load carrier attached to it. However, no particular angular orientation of the track-traveling element within that accessible range is required for the proper working of the system or for the unimpeded travel of the track-traveling element past the track support(s). Thus it is important to note that unimpeded travel of the track-traveling element past the track support(s) does not require particular pivoting, rotation, or any manipulation of the track-traveling element or of any portion of the track support. This feature especially is believed to be a significant improvement over available systems of the background art.

In applying the system to a fall-arrest safety installation, a worker's safety belt or harness can be attached via a lanyard to the track-traveling element. Movements of the worker, which are generally parallel with the safety track, e.g. a track formed by a wire cable or other funicular material, are unrestrained because the coupling means moves freely along the track in response to a pull on the lanyard. The worker is free to move away from the cable to the extent permitted by the length of the lanyard. The coupling means remains permanently coupled to the safety track so that the installation prevents or restricts any fall of the worker.

These and other details and advantages of my invention will be described in connection with the accompanying drawings, which are furnished only by way of illustration and not for limitation of the invention.

PREFERRED EMBODIMENTS AND BEST MODE FOR REALIZING THE INVENTION

Figure 1:
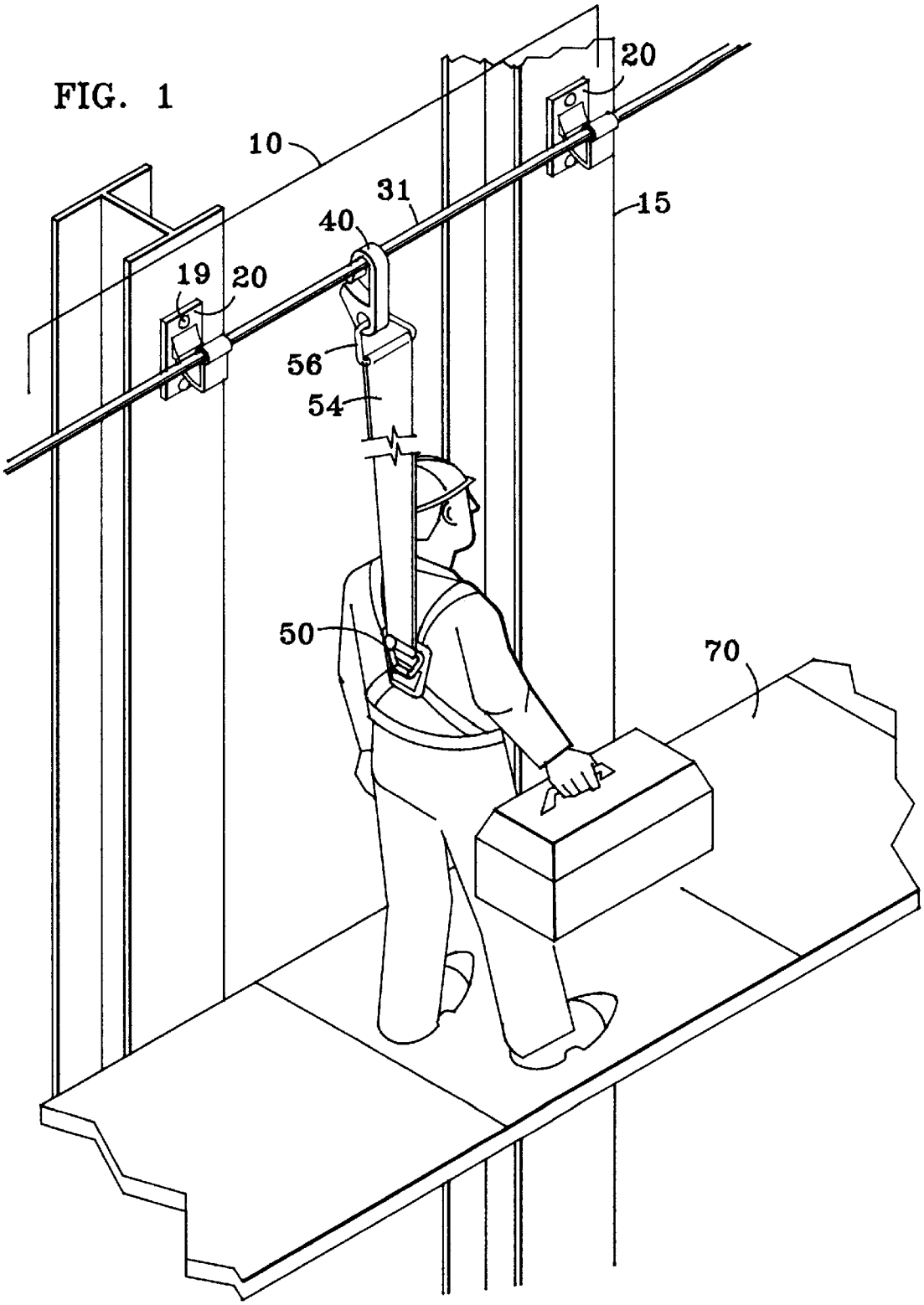
FIG. 1 shows a perspective view of a part of a personal fall-arrest system incorporating apparatus according to the invention.

A typical embodiment of the present invention (generally denoted by reference numeral 10) is illustrated in FIG. 1. A safety track 31, such as a wire cable, is anchored to the side of a fixed structure 15 adjoining a worker's walkway 70. Track 31 can follow a continuous course around the structure or be extended between anchor points where the ends of the cable are secured to the structure with suitable conventional end fixtures on the cable. Track-support brackets 20 are secured to the structure 15 at intervals along the course of the track 31 and serve to support track 31 in a spaced relation to that structure. Each of the supports comprises a cable support bracket 20 which is secured to the structure 15 with fastening bolts or other fasteners 19.

A track-traveling element 40 is placed onto the track 31 and is freely slidable along track 31. A worker's safety harness 50 is connected to the track-traveling element 40 via a lanyard 54. Should the worker fall, the fall-arrest loading forces are transmitted to the fixed structure via the safety harness 50, the lanyard 54, the cable track 31 and the track-support brackets 20. The lanyard, safety harness, or any other suitable part of the linkage may include conventional shock-absorbing features (not shown). A safety belt or other equivalent may be used for safety harness 50.

Figure 2:
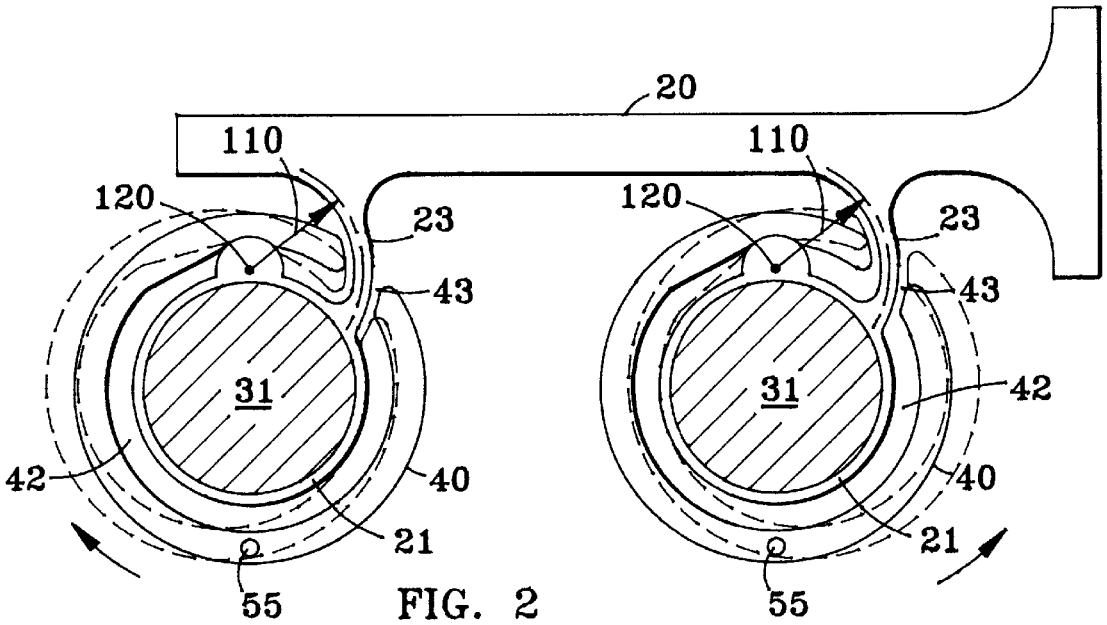
FIG. 2 shows an elevation view of an embodiment made in accordance with the invention and positioned to illustrate a range of angular relationships.

FIG. 2 shows an elevation view of a simple embodiment made in accordance with the invention and positioned to illustrate a range of angular relationships. One application that is well illustrated by FIG. 2 is a curtain rod system in which two rigid curtain rods act as tracks 31 (seen end-on in FIG. 2) supported by a track-support element 20, which in FIG. 2 is a dual-track version. The two tracks are often made parallel, but may be non-parallel. In a complete installation of this track transport system, a series of track-support elements would be installed, spaced at intervals along the desired path of the curtains or drapes. Inner and outer curtains or drapes (not shown) are hung separately from separate track-traveling elements 40. The curtains may be hung using load attachments denoted generally by 55, which in FIG. 2 are shown as small holes. For some applications, however, a portion of track-traveling element 40 may serve as an integral load support 55, without the provision of a separate hole. Track-traveling elements 40 are shown with displaced positions by dashed lines in FIG. 2 to illustrate the principle by which they can pass track-support element 20 unimpeded. Each track support element has a curvilinear arm portion 23 having the form of a sector of a circular arc with a predetermined radius of curvature 110 and a predetermined center of curvature 120. Each track-traveling element 40 is free to pivot about an axis within track 31 (the axis preferably being coincident with center of curvature 120, at least within a predetermined tolerance). Each track-traveling element 40 has a passageway 42 through which track 31 passes. A slot 43 extends from passageway 42 to the periphery of track-traveling element 40, and the slot is preferably made narrower than the width or diameter of track 31, thus preventing track-traveling element 40 from coming off the track. Slot 43 is spaced from the pivot point of track-traveling element 40 by a distance generally equal to the radius of curvature 110 of curvilinear arm portion 23. Radius of curvature 110 refers to the centerline of curvilinear arm 23, and the inner and outer surfaces of curvilinear arm 23 are made generally parallel to that centerline along at least most of their length. Slot 43 is made wider by a predetermined amount than the thickness of arm 23. Thus there is a useful range of angular orientation of track-traveling element 40 within which track-traveling element 40 passes curvilinear arm 23 unimpeded, regardless of its angular orientation within that range. This principle is illustrated clearly in the series of FIGS. 3*a*–3*c*.

Angular range

Figure 3A:
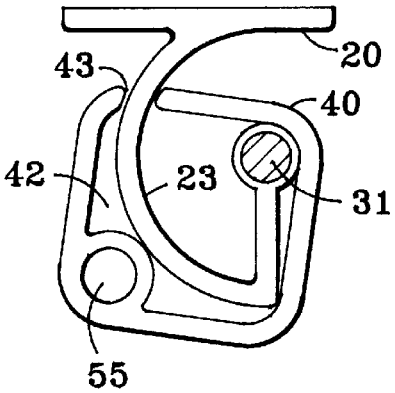
FIGS. 3*a*–3*c* show elevation views of another embodiment variously positioned to illustrate a range of angular relationships.
Figure 3B:
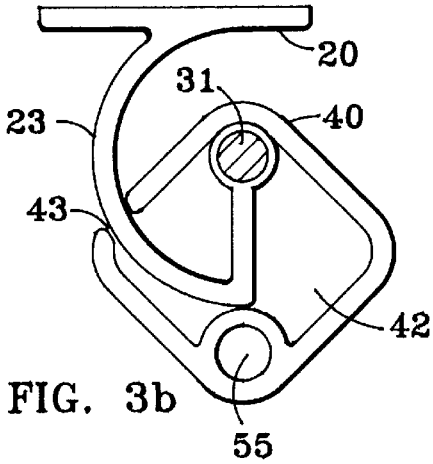
Figure 3C:
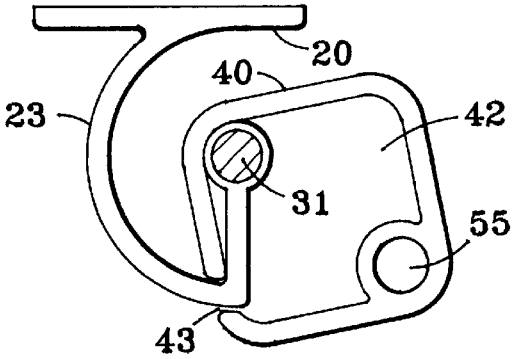

FIGS. 3*a*–3*c* show three elevation views of a particular embodiment, respectively positioned to illustrate a range of angular relationships. FIG. 3*b* shows track-traveling element 40 oriented in a "neutral" configuration relative to track-support bracket 20 (i.e. with load attachment 55 oriented straight down from the track). FIG. 3*a* shows track-traveling element 40 in an orientation rotated or pivoted about 53° clockwise relative to the neutral orientation of FIG. 3*b*. FIG. 3*c* shows track-traveling element 40 in an orientation rotated or pivoted about 54° counterclockwise relative to the neutral orientation of FIG. 3*b*. Thus the range of pivoting angles in this embodiment is about 107°. Track-traveling element 40 can pass unimpeded past track-support bracket 20 throughout this range. It will be recognized by those skilled in the art that even higher angular ranges may be made if desired by suitably optimizing the designs of track-traveling element 40 and track-support bracket 20, e.g. by decreasing the width of upper-arm 23 and increasing the width of slot 43.

The following detailed descriptions of various elements of the system refer to FIGS. 2–14*h*.

Track-support brackets

Figure 11:
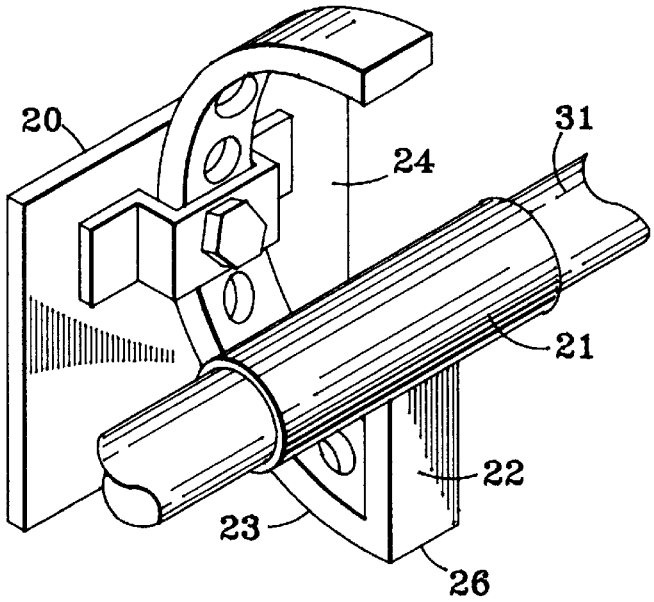
FIG. 11 shows a perspective view of an adjustable track support.
Figure 13A:
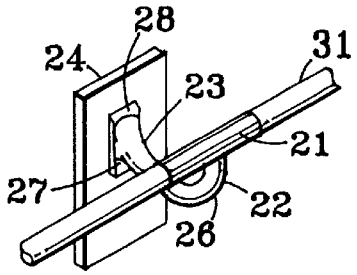
FIGS. 13*a*–13*m* show perspective views of various forms of portions of a track-support bracket.
Figure 13B:
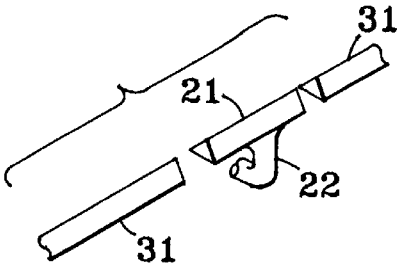
Figure 13C:
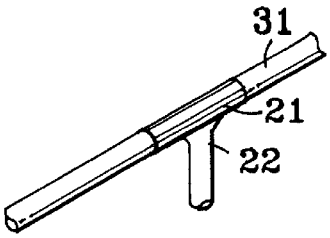
Figure 13D:
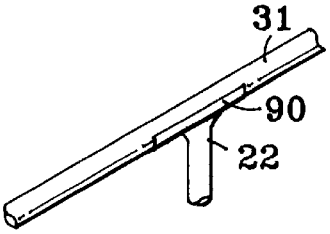
Figure 13E:
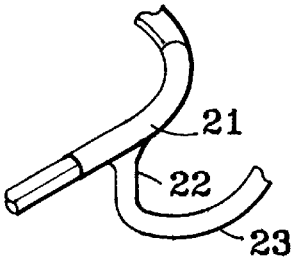
Figure 13F:
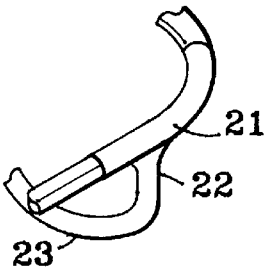
Figure 13G:
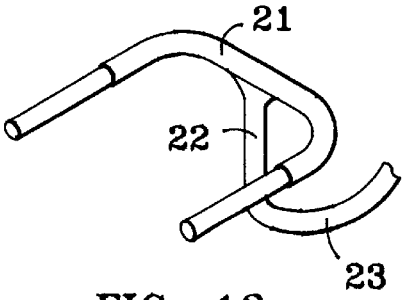
Figure 13H:
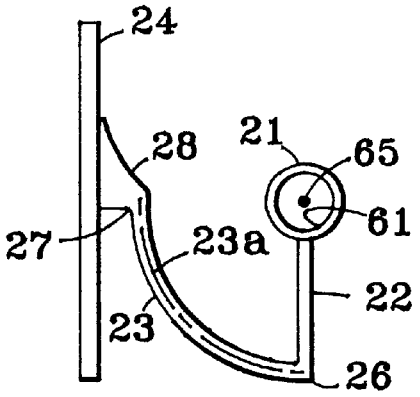
Figure 13I:
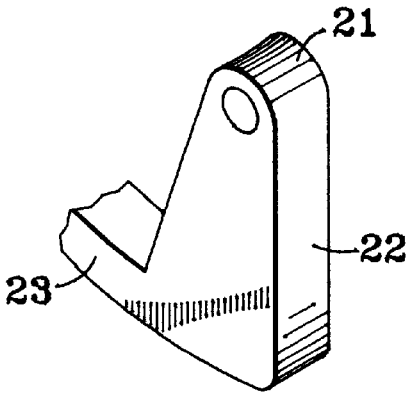
Figure 13J:
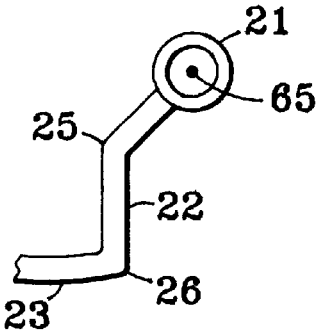
Figure 13K:
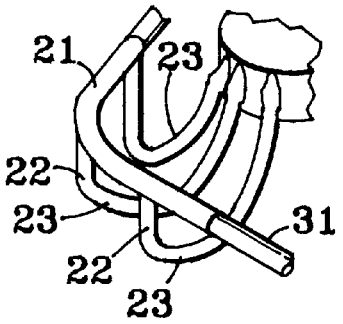
Figure 13L:
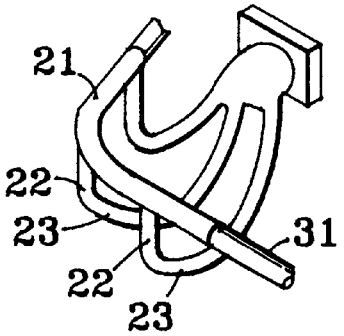
Figure 13M:
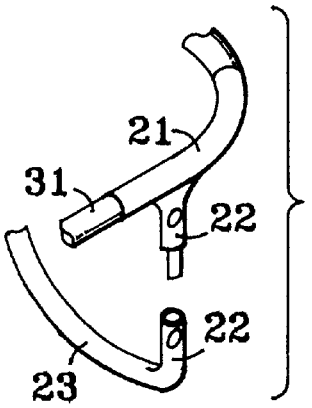

Some suitable forms of track-support brackets 20 are shown in FIGS. 2, 3*a*–3*c*, 4*a*, 5*a*–5*b*, 13*a*–13*m* and FIG. 14*f*. Referring specifically to FIGS. 13*a* and 13*h* which show the construction of particular brackets in detail, each bracket has a body portion 24, a fist portion 21 of a generally tubular form, a forearm 22 attached to a fist 21 at one end and to an elbow 26 at the other end. Elbow 26 connects forearm 22 to a curved upperarm 23 which is attached to body 24 forming an "armpit" 27 and sometimes a shoulder 28. Bracket 20 can be formed by molding, by casting and machining, by bending, by machining and assembling the components, or by any suitable combination of these methods. It can be made so that some of the parts such as fist 21 are interchangeable (as illustrated in FIG. 13*m*), and it can made to be adjustable (as illustrated in FIG. 11). Double track-support brackets can be made as in FIG. 2, FIG. 5*a*, or FIG. 5*b* which illustrate embodiments having various orientations of the curvilinear arms on two sides of double track-support brackets. FIG. 13*b* illustrates an embodiment for a track 31 of triangular cross-section.

Fist

Fist 21 is typically tubular in shape and the bore (inside diameter) is larger than the diameter of the track that is to extend through it, allowing the track 31 to slide through the tube. Fist 21 may accommodate sleeve 63 or extensions 62 for the ends of the tube, as shown in FIGS. 7*a*–7*d*. Extensions 62 or sleeve 63 reduce friction and wear especially at the inner radius 61. If used, sleeve 63 or extensions 62 are formed of a synthetic material or of a relatively softer metal. The inner edge 29 of the ends of fist 21 preferably has a radius 61 to reduce friction and wear unless a friction reducing insert 63 or extension 62 of synthetic or relatively soft metal (brass, aluminum, etc.) is used, in which case the extension 62 or insert 63 is formed with a radius. FIG. 13*c* illustrates an embodiment with a "closed fist" 21. FIG. 13*d* illustrates an embodiment with an "open fist" 21. FIG. 13*e* illustrates an embodiment with a curved fist 21 for guiding a track around a turn at an inner corner. FIG. 13*f* illustrates an embodiment with a curved fist 21 for guiding a track around a turn at an outer corner. FIG. 13*g* illustrates an embodiment with a curved fist 21 for guiding a track around a U-turn. FIG. 13*i* illustrates an embodiment with a fist 21 formed integrally with a thick forearm 22. FIG. 13*j* illustrates an embodiment having a bent forearm 22, with a bend 25. FIGS. 13*k* and 13*l* illustrate track-support components having plural curvilinear arms 23. The centerline 65 of fist 21 is made coincident with axis 120 in some embodiments, such as that of FIGS. 3*a*–3*c*.

Forearm

Forearm 22 may be made integrally, from the same material or same piece of material from which fist 21 and upperarm 23 are constructed. The purpose of forearm 22 is to hold fist 21 at a location that is equidistant from all the points of arcuate upperarm 23 as shown in FIG 13*h*. The distance from the center 65 of fist 21 to the arcuate centerline 23*a* of upperarm 23 is made equal for all points of the arcuate centerline 23*a* of upperarm 23; i.e. the arcuate centerline 23*a* is a sector of a circle. Forearm 22 is attached or integrally formed to fist 21 and they are typically perpendicular to each other. At the other end of forearm 22, the forearm is terminated in an elbow 26 that is a part and extension of the forearm 22 and that is a part and extension of the upperarm 23 beyond. Stated in another way, elbow 26 is preferably made integral with the forearm and upperarm. The embodiment of FIG. 2 has no forearm 22.

Elbow

Elbow 26 is essentially the apex of an angle formed between the forearm 22 and the upperarm 23. The angle formed is typically made between 45° and 135° and in most applications would be about 90°. It will be apparent to those skilled in the art that elbow 26, if present, may be made without a sharp outer edge and is preferably formed with a chamfered or rounded contour. The embodiment of FIG. 2 has no elbow 26.

Upperarm

Figure 9:
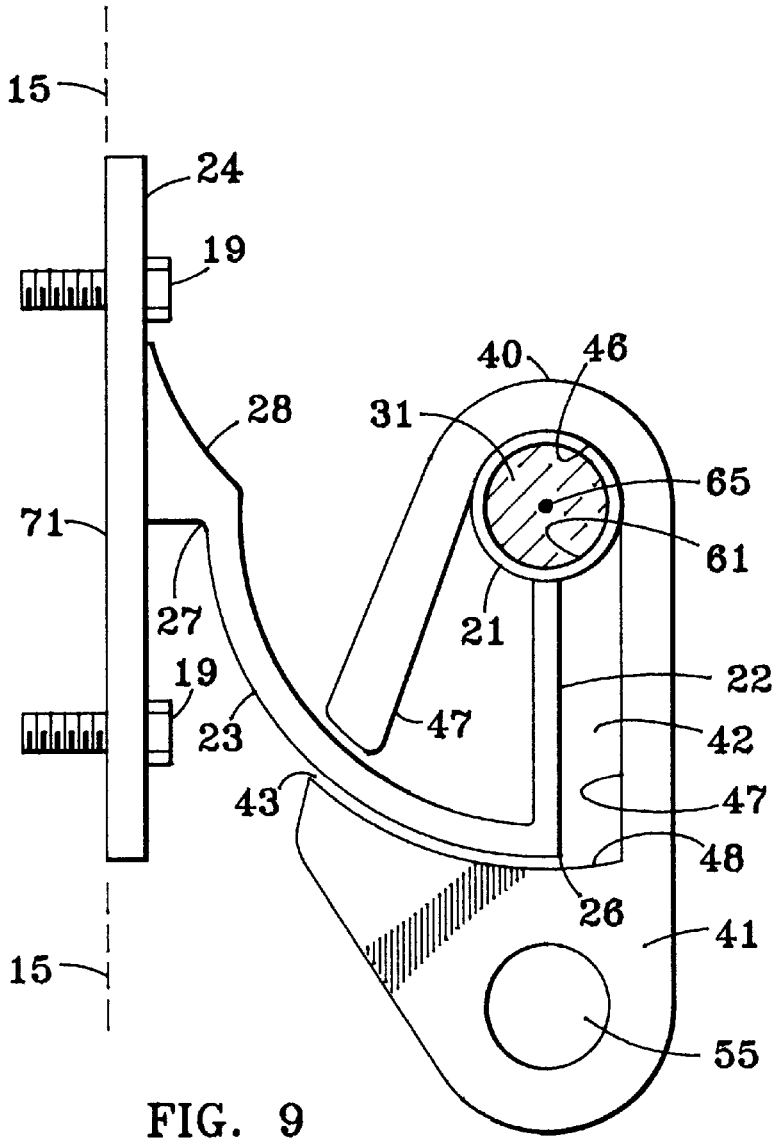
FIG. 9 shows an elevation view of a track support and a track-traveling element and their spatial relationship.

Upperarm 23 is preferably constructed of the same material as fist 21, forearm 22, and elbow 26. In the embodiment of FIGS. 9 and 13*h*, for example, upperarm 23 is formed into an arcuate shape having a radius equal to the distance from the center 65 of the bore of fist 21 to the outermost portion of elbow 26. At one end, upperarm 23 is integrally formed or attached to elbow 26, and at the other end it is formed or attached to a body 24 of track-support bracket 20. The inner and outer curvilinear surfaces of upperarm 23 are preferably made parallel to its arcuate centerline so that they too have the form of circular segments, and the curvilinear arm 23 has a substantially constant thickness along at least most of its length.

Armpit

Armpit 27 is inherently formed at the intersection between upperarm 23 and body 24 of the track-support bracket where the curved upperarm 23 joins body 24 of the track-support bracket 20. While not a separable element of the structure, armpit 27 is denoted herein by a distinct reference numeral to clarify its functional purpose: armpit 27 serves the purpose of providing clearance for the track-traveling element 40 as it passes by the track-support bracket 20.

Shoulder

A shoulder 28 may be formed as an extension and part of the upperarm 23 at the upper side of the upperarm/body attachment. If desired, shoulder 28 may be formed directly opposite upperarm 23 from armpit 27. The choice of whether or not a shoulder 28 is formed depends on the particular shape chosen for the track-traveling element to adapt it for specific applications. Some shapes of the track-traveling element may require a shoulder 28 in order to have sufficient clearance. In many cases a shoulder is not needed and may be omitted.

Body

Figure 14A:
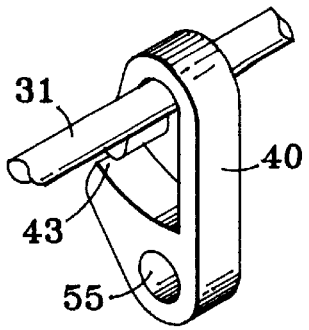
FIGS. 14*a*–14*h* show perspective views illustrating various forms of track-support brackets and track-traveling elements.
Figure 14B:
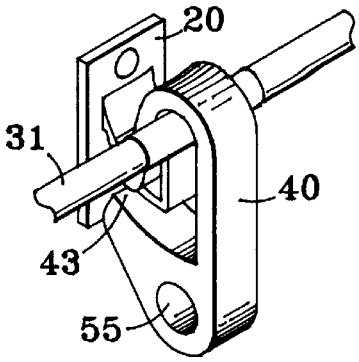
Figure 14C:
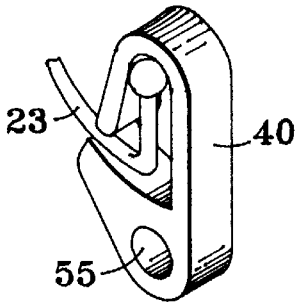
Figure 14D:
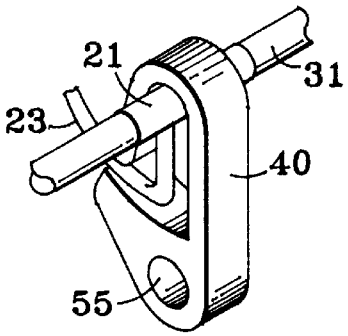
Figure 14E:
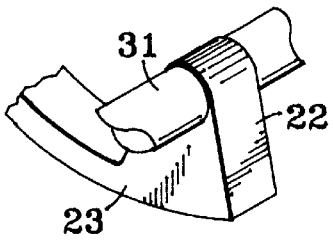
Figure 14F:
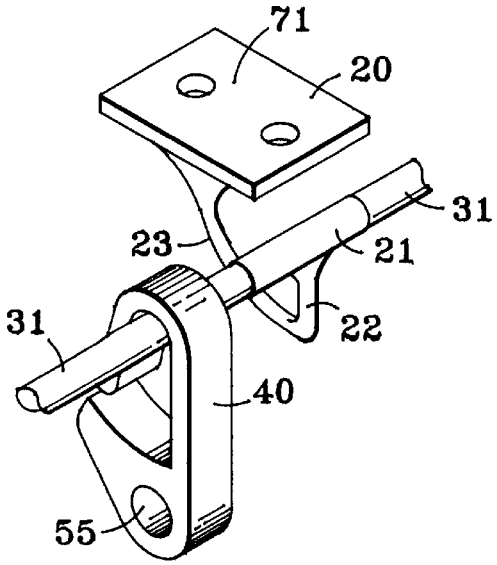
Figure 14G:
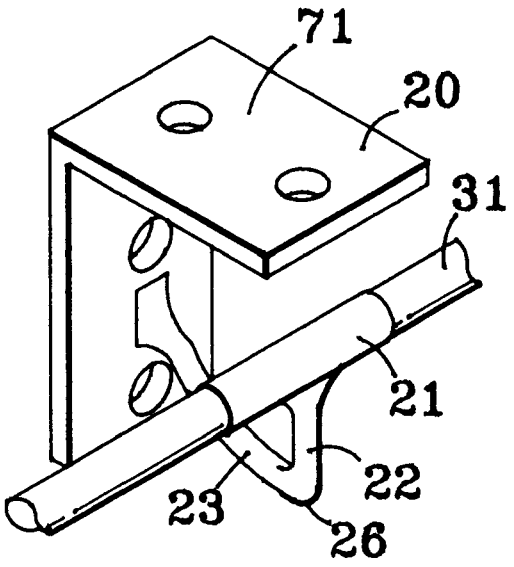
Figure 14H:
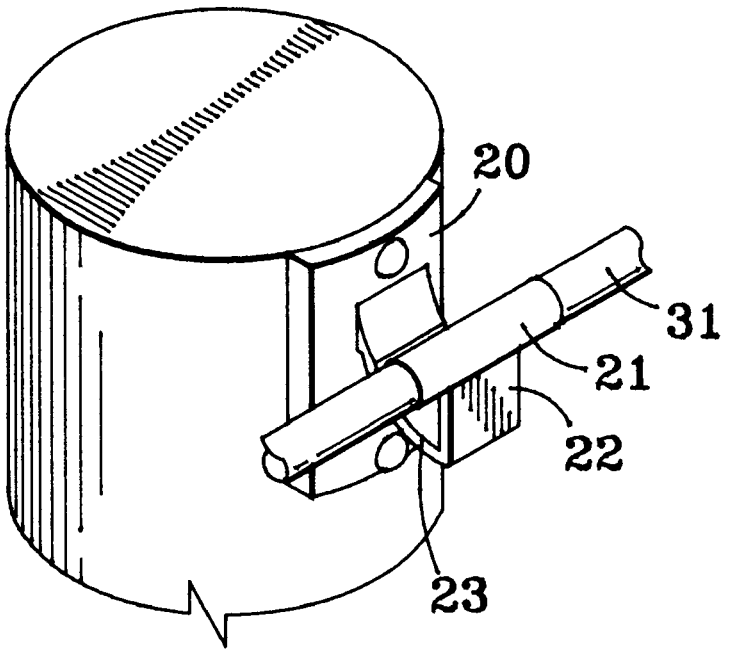

The purpose of body 24 is to provide a strong and stable termination of the upperarm 23 and a stable means for securing track-support bracket 20 to a supporting structure 15. Body 24 can be shaped in many ways and properly perform its function. The structure-contact surface 71 of the body that rests against the structure 15 is preferably formed so that all points of that surface 71 contact the surface of the structure 15 as shown, for example, in FIG. 14*h*. The means for attaching a track-support bracket 20 of a fall-arrest system to a fixed structure 15 would preferably be by use of a bolt 19 or bolts as shown in FIG. 9. The two most common attachments of brackets 20 to a structure 15 for this system are typically attachments to a vertical or to an overhead horizontal structure 15 as shown in FIG. 1 and FIG. 14*f*, or to both as in FIG. 6 and FIG. 14*g*. A hinged, angular, or adjustable track-support bracket body may be used to attach to the roofs or peaks of buildings or to other slopes to provide fall-arrest protection for workers performing duties while on or below a sloped surface. A track support bracket for use on a sloped surface such as that of a roof may have its base and forearm parallel to the sloped surface. In situations where load attachment means 55 depends on gravity, the roof surface may constrain somewhat the range of angles available for pivoting the track-traveling element. Track support body or base 24 may be made curved when it is desired to attach it to a curved support structure such a cylindrical column, as shown in FIG. 14*h*.

Track-traveling element

Figure 10:
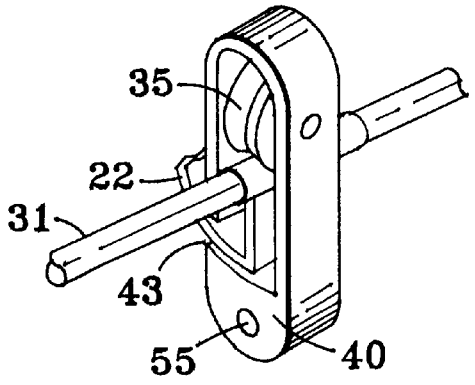
FIG. 10 shows a perspective view of a portion of a track support and another track-traveling element and their spatial relationship.

Some of the forms of track-traveling element 40 are shown in FIGS. 2, 3*a*–3*c*, 6, 9, 10, 12*a*–12*b*, 14*a*–14*d*, and 14*f*. Referring to FIGS. 9 and 10, which show the construction of particular embodiments of track-traveling elements 40 in detail, track-traveling element 40 has a body 41, from which is carved a passageway 42 that allows passage of fist 21, forearm 22 and a portion of upperarm 23 of the cable supporting bracket 20. Track-traveling element 40 also has a slot 43 for passage of the upperarm 23 of the track-support bracket 20, and has a means (55, 56) for attaching a worker's safety lanyard 54 or more generally for attaching a load carrier 53. A pulley-like wheel 35 may be provided as part of the track-traveling element 40.

Passageway

A passageway 42 through track-traveling element 40 is preferably formed such that it is shorter at its horizontal axis than at its vertical axis and is narrower at the top than it is at the bottom. The inner surface at the upper end of the passageway 42 (hereafter called "ceiling" 46) preferably has a curved surface joining two inwardly sloping walls 47. The curve of ceiling 46 is made to have a slightly larger radius than the radius of the outside diameter of fist 21 of the track-support bracket 20. The width of the lower portion of the passageway 42 (hereafter called "floor" 48) is preferably greater than the width of the upper portion of passageway 42 at the ceiling 46 end. The height of the passageway 42 from floor 49 to ceiling 46 is made slightly higher than the height of the track-support bracket 20 measured from the outside or bottom of elbow 26 to the top of fist 21. The ceiling 46 of passageway 42 should be of a smooth texture to allow easy travel and to reduce the friction of the track-traveling element 40 along the track and over the track supporting brackets 20. The edges at each end of the passageway 42 are chamfered or preferably rounded to eliminate sharp edges that might cause excessive wear to track 31 and to the ends and top of fist 21 of the track-support component 20.

Slot

The form of slot 43 is shown in several drawings, including FIGS. 2, 3*a*–3*c*, 9 and 10. Slot 43 extends through the side wall 47 of track-traveling element 40 from passageway 42 to the outside periphery of track-traveling element 40 and extends longitudinally from end to end (parallel to track 31 and parallel to floor 48 and ceiling 46 of track-traveling element 40). Slot 43 is made slightly wider than the maximum width of upperarm 23 of the cable supporting bracket 20 and is preferably made narrower than the diameter of fist 21 of track-support bracket 20. Stated in the converse manner, the first-mentioned relationship is that upperarm 23 of the cable supporting bracket 20 is made narrower than the width of slot 43, at least over that portion of its length that passes through slot 43. Slot 43 is located at the level of floor 48 or slightly above. Slot 43 may have an arcuate shape corresponding to the arcuate shape of upperarm 23. It will be seen, from FIGS. 9 and 12*a*–12*b* for example and from this description, that slot 43 is generally not a "radial" slot, in that its axis does not pass through the center 65 of the bore of fist 21 of track-support bracket 20, nor through the axis of track 31.

Lanyard Attachment

Lanyard or load attachment 55 is at the lower end of the track-traveling element 40 and can be as simple as a hole (preferably with rounded edges) to which a permanent and/or temporary attachment can be made. Load attachment 55 is shown as a hole, but for some applications, a separate hole is not needed, and a load can simply be attached by a supporting element such as a rope, cable, wire, hook, loop, ring, etc. passing through passageway 42 and supported by floor 48 and/or walls 47. Ring 56 shown in FIG. 7 illustrates such an arrangement.

Figure 4A:
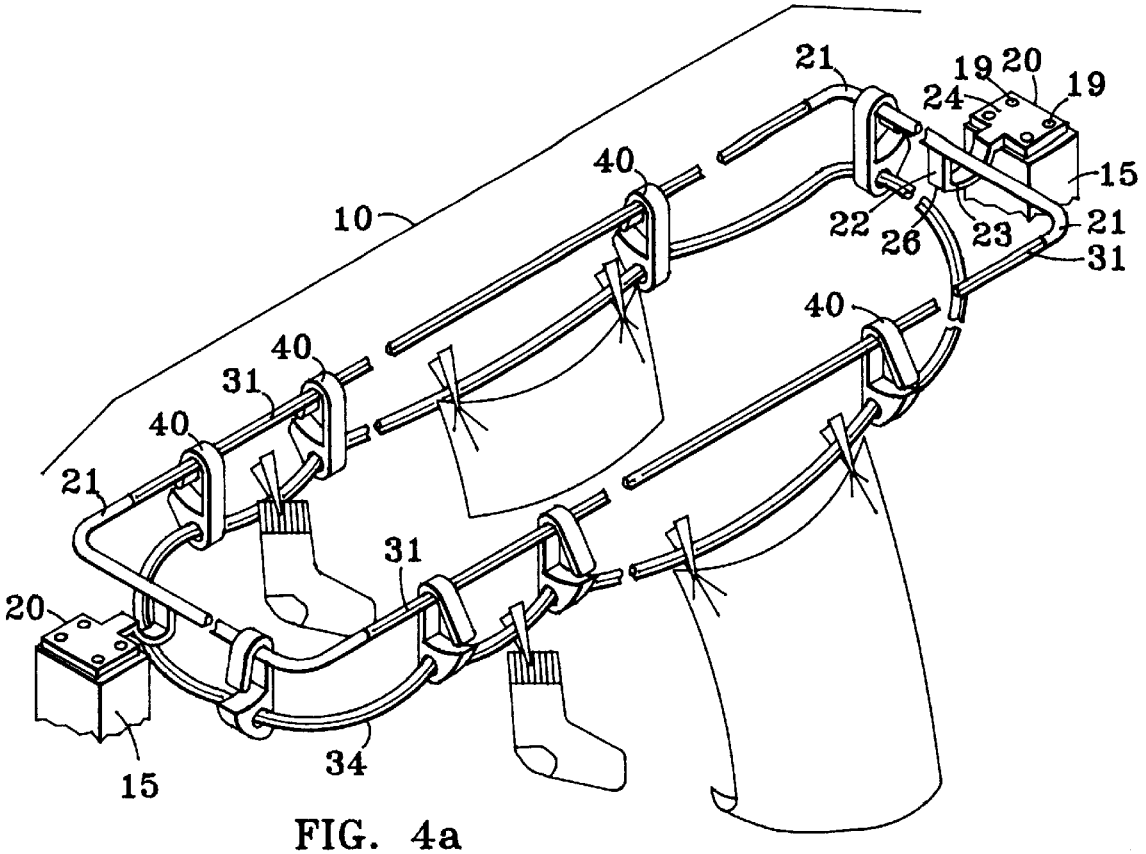
FIG. 4*a* shows a perspective view of a clothesline embodiment incorporating apparatus according to the invention.
Figure 4B:
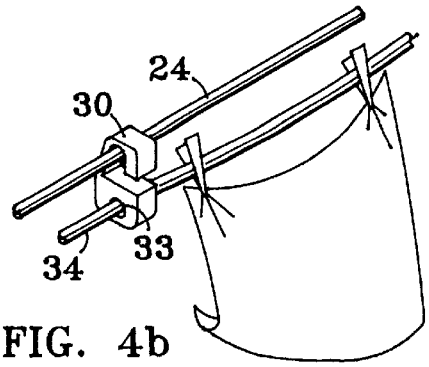
FIG. 4*b* shows a perspective view illustrating a detail of an another embodiment.
Figure 5A:
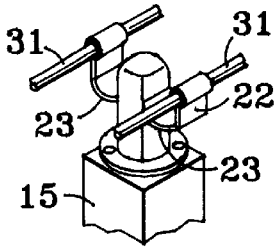
FIGS. 5*a*–5*b* show perspective views of details of alternative embodiments of track supports.
Figure 5B:
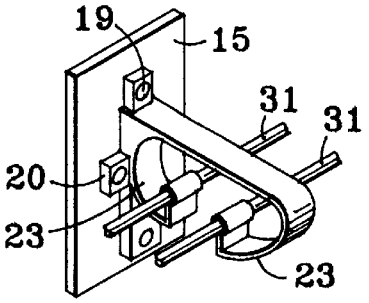

FIGS. 4*a*–4*b* show perspective views of a clothesline embodiment according to the invention. In FIG. 4*a*, track 31 forms a closed loop, which may be in a horizontal plane. Track supports 20 at each end have generally U-shaped fists 21 that provide 180 degree turns for track 31. Track-traveling elements 40 can pass the supports unimpeded. Track-traveling elements 40 are attached to each other by a line 34. Line 34 and articles attached to it can be moved continuously around the loop of track 31, so that specific articles may be added or removed at various positions along line 34 without the need to remove other articles at intermediate positions. The articles may be clothes, clotheshangers, or any other articles to be transported. FIG. 4*b* shows a detail illustrating a track-traveling component 30 of slightly different form. FIGS. 5*a* and 5*b* show details of alternative track support designs.

For some applications, a flexible track may be used, and the flexible track may be selected and arranged to be longitudinally movable through the track supports, with means provided for moving the flexible track through the track supports. The means for moving the flexible track through the track supports may be, for example, a conventional electric motor driven by electrical power, the output of the electric motor being coupled by conventional means to the flexible track.

Fabrication Materials And Processes

Because the uses of the invention are so varied, the choices of materials for making the components and the fabrication processes used for making components also vary considerably. For supporting light-weight loads such as small toys, for example, all the components of the system may be made of plastic materials. Track supports and track-traveling elements may be molded of the plastic materials and the track may be molded, extruded or spun from plastics or natural fibers, for example. For moderate loads such as drapes or clothesline systems, suitable materials include metals, but some parts can still be made of plastics. For example, a track for drapes may be formed with extruded aluminum tubing, and track supports and track-traveling elements may be formed of wood, molded of suitable plastics such as rigid ABS or PTFE, or cast using metals such as aluminum. For heavy loads and safety installations, it is generally preferable to form the parts from metal. For example, a worker's fall arrest system can be made using steel cable for the track and machined steel for the track supports and the track-traveling element. As mentioned above, some parts such as extension 62 or sleeve 63 shown in FIGS. 7*a*–7*d* are preferably formed of a synthetic material such as PTFE or of a relatively soft metal such as brass or aluminum for reduced friction and/or wear of other elements.

The person of ordinary skill will recognize that the materials should be chosen to have sufficient strength, rigidity, dimensional stability and other properties suitable to the application, and that the fabrication processes should be adapted to the materials used as well as the economics of the application. In all the applications, it is important to ensure that the cooperating relationships among the components as described in this specification be maintained. For example, the track-traveling element must be made sufficiently rigid and dimensionally stable so that its slot fits over the curvilinear arm of the track support under all the conditions to be encountered during use of the system.

Operation

Various aspects of operation of the invention are illustrated in FIGS. 1, 2, 3*a*–3*c*, 4*a*–4*b*, 6, 9–11, 12*a*–12*b*, 14*a*–14*d*, 14*f*, 14*h*, 15 and 16.

Figure 6:
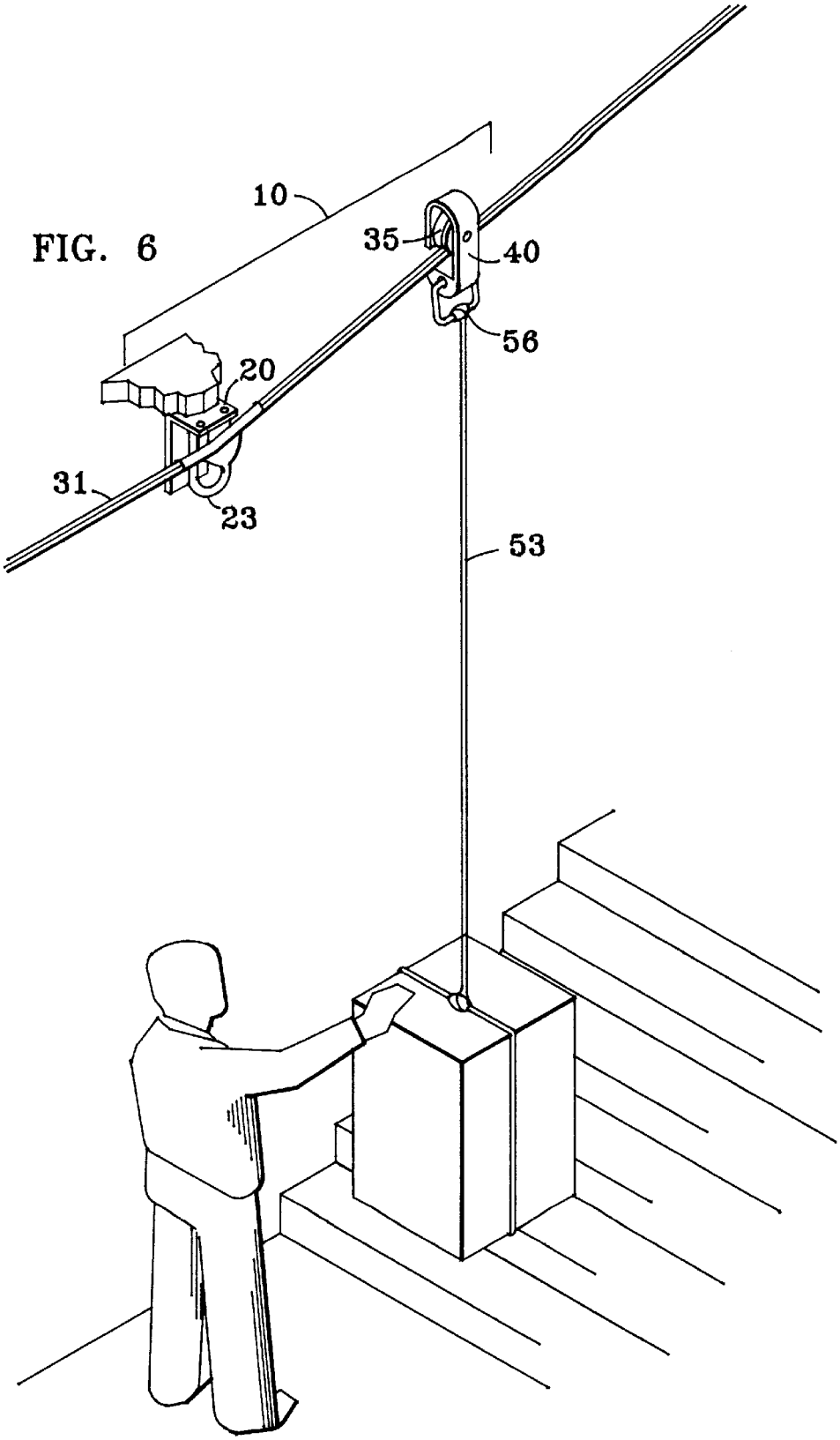
FIG. 6 shows a perspective view of a hand operated conveyor system apparatus made in accordance with the invention.
Figure 7A:
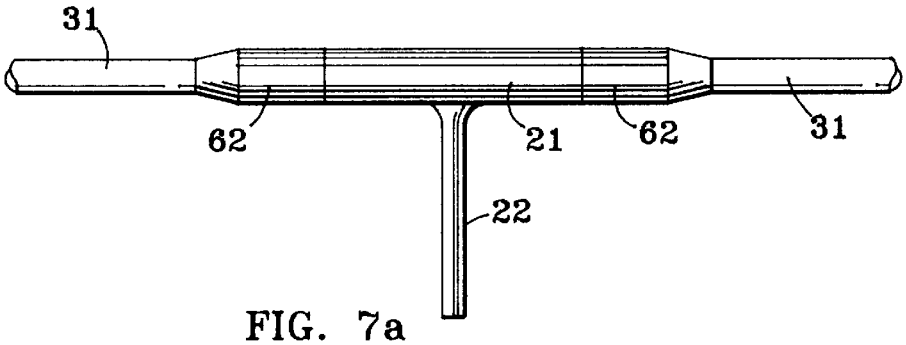
FIGS. 7*a*–7*d* show side elevation views of details of a fist portion of a track-support bracket, with some portions partially cut away.
Figure 7B:
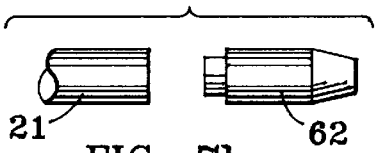
Figure 7C:
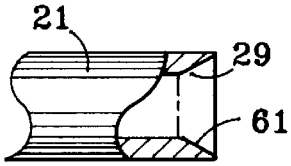
Figure 7D:
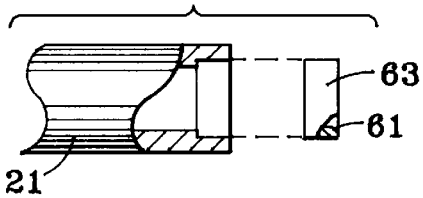
Figure 8:
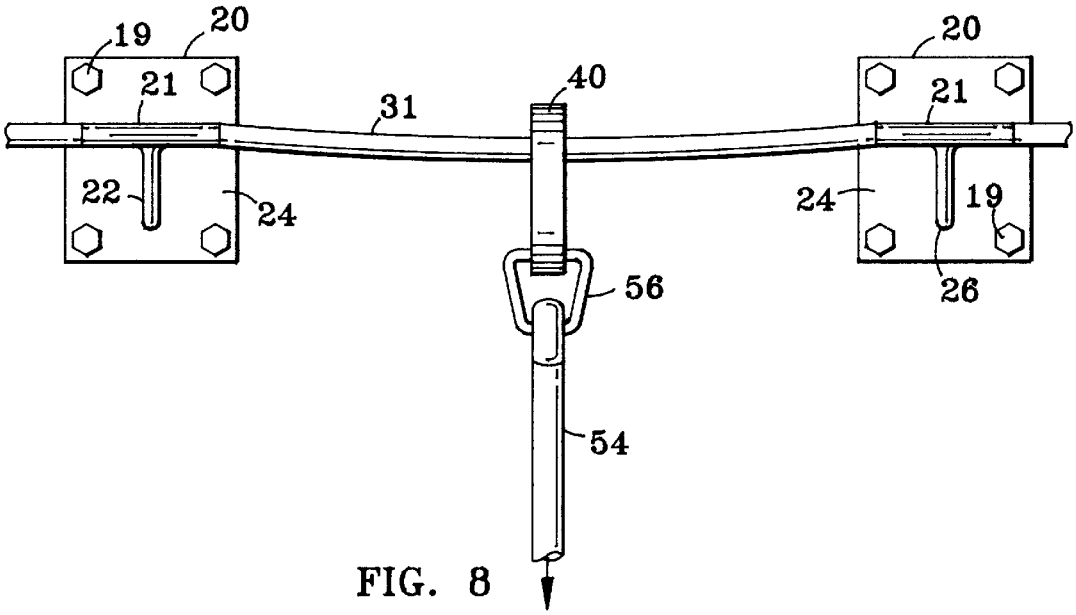
FIG. 8 shows an elevation view of a portion of a track-transport fall-arrest system in its configuration at the moment of fall arrest.

In operation, a track 31 is suitably anchored at its ends (not shown in FIG. 1) to a structure 15 and is partially supported at points along its length by one or more track-support brackets 20. The purposes of track-support brackets 20 include supporting the track, giving the track more rigidity, providing more strength to the system, and providing a way for track 31 to change directions. A track-traveling element 40 is threaded onto the track 31 and is displaceable along the length of the track by sliding along the track, as shown in FIGS. 1, 2, and 3*a*–3*c*, or by rolling along the track by way of a wheel 35 or wheels mounted in or on the track-traveling element 40 (with wheel 35 making contact with the track 31), as shown in FIGS. 6 and 10.

Figure 12A:
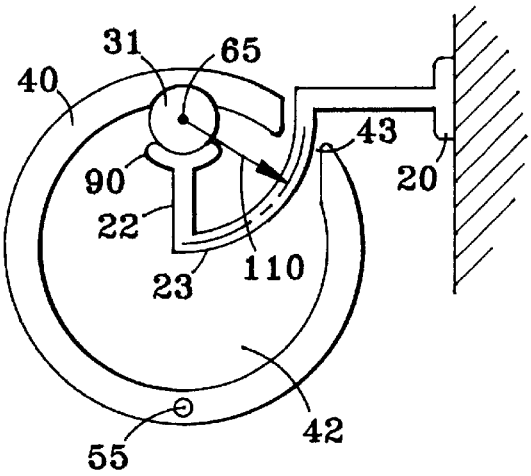
FIGS. 12*a* and 12*b* show in elevation views alternative forms of track-traveling elements and corresponding track supports.

Track 31 of FIG. 12*a* may be either rigid or flexible, depending on the application. For some applications, the track 31 may merely rest on the seat 90 located at the top of forearm 22 of track support 20, but in most applications it is preferable that track 31 be fixed to the seat 90 of track support 20. If track 31 is fixed to track support 20, it may be fixed with a suitable conventional adhesive or other suitable conventional fastening means (not shown) that does not protrude so as to interfere with passage of the track-traveling element 40. Track-traveling element 40 is pivotable about a pivotal axis 65. In FIG. 12*a*, the pivotal axis 65 of track-traveling element 40 is parallel to track 31. It will be seen both from FIG. 2 and from FIGS. 3*a*–3*c* that the track-traveling element 40 of FIG. 12*a* is pivotable over an angular range about its pivotal axis 65 even while it is passing the track support bracket 20. As described above with reference to FIGS. 3*a*–3*c*, this angular range of pivoting angles can be more than 100°. FIGS. 3*a*–3*c* show track-traveling elements 40 in various pivoted orientations relative to the track support bracket 20 ranging from about 53° clockwise to about 54° counterclockwise. FIGS. 3*a* 3*c* show track-traveling elements 40 in various pivoted orientations relative to track support bracket 20 while track-traveling elements 40 are passing track support bracket 20. Passageway 42 is large enough to allow passage of both the track-locating means ("fist") 21 and at least a portion of curvilinear arm 23 of track support bracket 20. Slot 43 communicates between the periphery of track-traveling element 40 and passageway 42. The width of slot 43 is wide enough for passing curvilinear arm 23, i.e. slot 43 is wider than the thickness of curvilinear arm 23. In FIG. 12*a*, the pivotal axis 65 of track-traveling element 40 is also the center of curvature of curvilinear arm 23 which is in the form of an arc of a circle. Thus, in operation, curvilinear arm 23 is concentric with pivotal axis 65 of track-traveling element 40. Thus the passageway 42 in the track-traveling element 40 of FIG. 12*a* operates qualitatively in the same manner as respective passageways 42 in the similar track-traveling elements shown in FIGS. 2 and 3*a*–3*c*, enabled by the disposition and width of slot 43 in each embodiment. FIGS. 3*a*–3*c* and 12*a* all illustrate the important features, viz., that curvilinear arm 23 is made to be substantially concentric with the pivotal axis 65 of track-traveling element 40, and arm 23 has a radius 110 substantially equal to the distance of slot 43 from pivotal axis 65 of track-traveling element 40. Thus the axis of rotation 65 of track-traveling element 40 coincides with the center of curvature of curvilinear arm 23, and the distance of slot 43 from that axis of rotation equals the radius of curvature of curvilinear arm 23. This precise geometric relationship, whereby the path of motion of the slot during rotation matches the curve of curvilinear arm 23 is illustrated by FIGS. 3*a*–3*c* and 12*a*–12*b*. These concentricity relationships and the manner in which the slot 43 and the curvilinear arm 23 cooperate, make it possible for track-traveling element 40 to pass track support 20 at any angular orientation within a wide range of angular orientations, as described above.

Figure 12B:
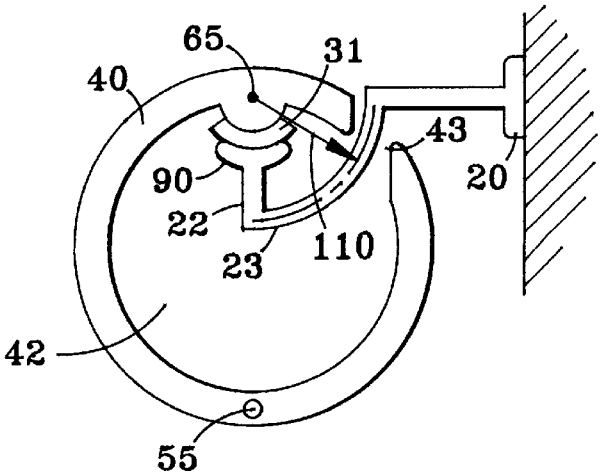

Also shown in FIGS. 12*a* and 12*b* is an optional variation in the form of the track-traveling element 40. This optional variation is not required for basic operation of the track-traveling element. If track 31 has a round contour (shown convex in FIG. 12*a* and concave in FIG. 12*b*), a portion of the inner surface of passageway 42 may be formed with a round contour conforming to the round contour of track 31. Thus in FIG. 12*a,* the portion of the inner surface of passageway 42 conforming to the contour of track 31 is a concave round recess. Similarly, in FIG. 12*b,* the portion of the inner surface of passageway 42 conforming to the round concave contour of track 31 is a convex round protrusion extending into passageway 42. If used, such optional variations preferably have a center of curvature coinciding with the pivotal axis 65 of track-traveling element 40 as shown in FIGS. 12*a* and 12*b*. Such optional variations do not prevent normal pivoting of the track-traveling element 40 around its pivotal axis 65.

It will be seen from FIGS. 3*a*–3*c* and 12*a*–12*b* that the mass of track-traveling element 40 is distributed eccentrically with respect to axis 65. Any load attached to track-traveling element 40 will add eccentricity, thus increasing the eccentricity of the combined masses of load and track-traveling element 40. However, the pivotal rotation of track-traveling element 40 always remains concentric to axis 65. Since track-traveling element 40 is a rigid body, every point within track-traveling element 40 rotates concentrically about the same axis 65.

The track-traveling element 40 can be moved along the track 31 by the action of gravity pulling on it, as in the case of an inclined track, or it can be powered by mechanical means and some source of power.

When track-traveling element 40 approaches track-support bracket 20, it slides or rolls up onto fist 21 of track-support bracket 20, and the fist 21 of the track-support bracket 20 enters passageway 42 of track-traveling element 40. Track-traveling element 40 is aided in the transition from movement along track 31 to movement along fist 21 of track-support bracket 20 by a tapered end of fist 21 of track-support bracket 20. As track-traveling element 40 moves along fist 21 of track-support bracket 20, fist 21 begins to pass through passageway 42 of track-traveling element 40 (either by way of ceiling 46 of track-traveling element 40 sliding on the uppermost portion of the outside diameter of fist 21 of track-support bracket 20, or by rolling of a wheel 35 or wheels mounted in or on track-traveling element 40 in contact with the uppermost portion of the outside diameter of fist 21 of track-support bracket 20). As the track-traveling element 40 progresses along fist 21, forearm 22 of track-support bracket 20 passes through passageway 42 of track-traveling element 40, and part of upperarm 23 of track-support bracket 20 also passes through passageway 42 of track-traveling element 40, while another part of the upperarm 23 of the track-support bracket 20 passes through slot 43 in wall 47 of passageway 42, and the remaining portion of upperarm 23 of track-support bracket 20 passes by the outside of track-traveling element 40. No part of the upperarm 23 of the track-support bracket 20 comes into contact with the slot, passageway, or any other part or surface of the track-traveling element 40.

Track-traveling element 40 can approach track-support bracket 20 from along track 31 at either side of track-support bracket 20 with equal ease of operation. While in contact with fist 21 of track-support bracket 20, the track-traveling element 40 follows the course set by fist 21 of track-support bracket 20 and, after passing track-support bracket 20, may be traveling in a different direction than it was traveling when it approached track-support bracket 20. A track-support bracket 20 is adapted to provide such a change of track direction by forming fist 21 to have an arcuate or curvilinear shape suitable for guiding track-traveling element 40 around a curve or corner as desired.

The distance that a load or a worker can move or be moved perpendicularly away from an overhead track 31 is controlled by the length of lanyard 54 or load carrier 53, not by the width of passageway 42 through track-traveling element 40.

The shape of a track course is defined generally by the track-support brackets 20 and is limited only by the availability of suitable structure 15 to which track-support brackets 20 may be attached. Brackets 20 may be constructed that overcome some of the problems posed by limited structure. The U-shaped track-support bracket illustrated in FIG. 4*a* provides a way for a track 31 to make a 180° turn and return on a parallel course. The double bracket illustrated in FIG. 5*b* provides a way for parallel tracks 31 to be supported by attachment to only one structure point.

Figure 15:
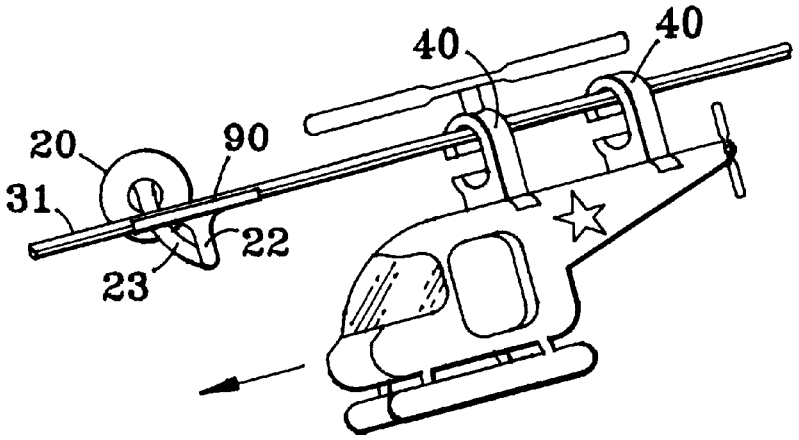
FIG. 15 shows a perspective view of a gravity-propelled toy made in accordance with the invention.

Another method of operation is shown in FIG. 15, which shows an example of a system where the load propels itself along the course of the track 31. A child's toy is shown on an inclined track 31 and moves propelled by gravity past the open-fisted track support 90 by way of track-traveling elements 40 built into and made an integral part of the toy. Track support brackets 20 in this application are made in a suction cup design that are easy for a child to attach to a supporting structure and which require no holes or other damage be made to the supporting structure.

Figure 16:
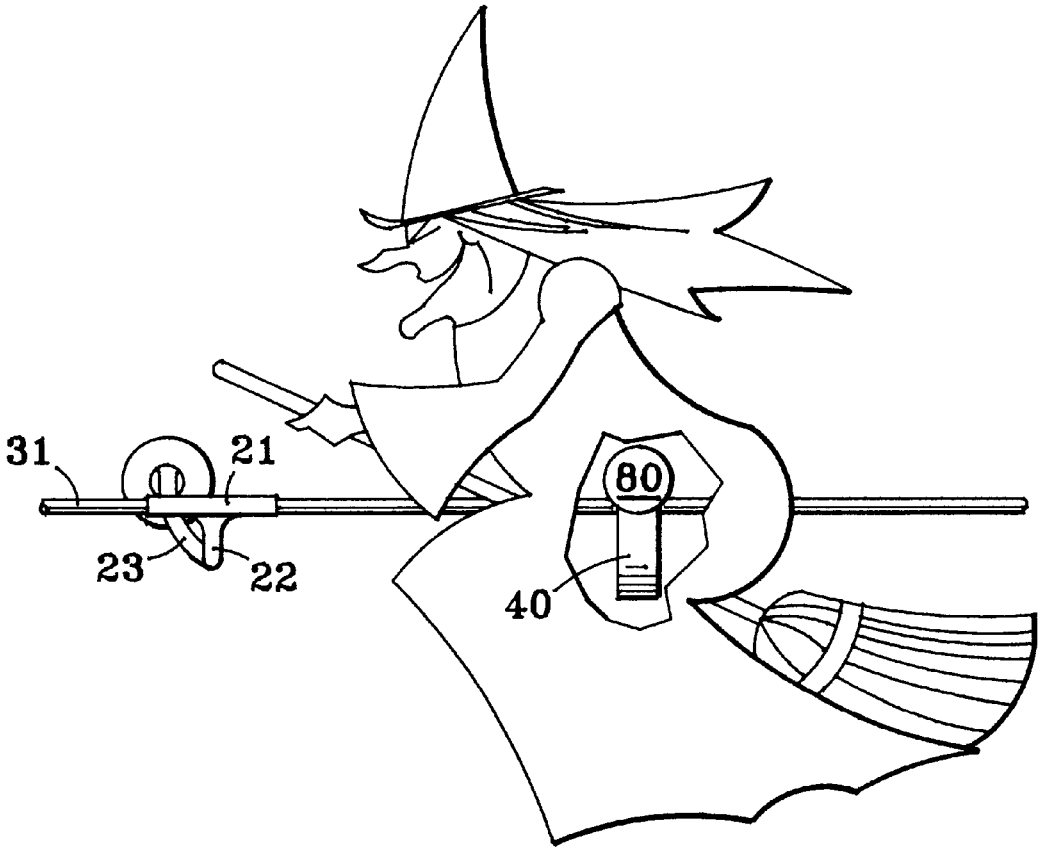
FIG. 16 shows a perspective view of a motor-propelled toy made in accordance with the invention.

FIG. 16 shows another child's toy that is powered by a battery-operated motor, a wind-up spring-powered drive mechanism, or other motor means 80. The track-traveling element 40 is built into and made an integral part of the toy in this application also.

Another method of operation that uses the track, track-support bracket and track-traveling element for a conveyor system is also illustrated by FIG. 4*a*, where any type of load may be substituted for the clothing shown. The conveyor system is hand- or power-operated and moves a number of loads by means of a single power source. The track support brackets 20 may be the same as for the fall-arrest system shown in FIG. 1. Considering clothesline 34 of FIG. 4*a* simply as a connecting element, the plurality of track-traveling elements 40 are connected to each other by connecting element 34 that constrains the track-traveling elements 40 to move in unison. Each track-traveling element is fixed to connecting element 34. The plurality of track-traveling elements 40 are spaced along the continuous track 31. The group of track-traveling elements 40 is moved by pulling on the connector 34 in a direction parallel to the direction of the track 31. Each track-traveling element 40 along the track 31 moves when the connector 34 is pulled because they are all connected together by the connector 34. In the system shown in FIG. 4*a,* adapted as a conveyor system, a motor 80 may be used to propel a continuous conveyor system that moves multiple loads along track 31, each load being attached to a track-traveling element 40.

Thus the reader will see that the bracket 20, the track-traveling element 40, and system of the invention provide a versatile, reliable, and economical device that can be used for many types of applications and that operates with a minimum amount of energy-wasting and wear-producing friction.

INDUSTRIAL APPLICABILITY

The track-support bracket and matching track-traveling apparatus of this invention provide components and a fall-arrest system that protect workers at elevated heights while allowing mobility of the workers to move freely along a track in a work area, that provide components and a track-support system that is easy to install and maintain, that provide a single- or multiple-track-support system which allows propelling a load past anchor points without disconnecting and re-connecting to the system, that provide a single- or multiple-track-support system that allows a load to travel around corners without disconnecting and re-connecting to the system, that provide a track-support system which functions with a minimal amount of friction and wear, and that provide a multiple track-support system which eliminates forced frictional orientation of a track-traveling element passing a track support. The system also provides components and a single- or multiple-track-support system that can be used in a wide range of applications where existing systems are difficult to use.

A system of this type is useful in numerous applications including but not limited to fall-arrest safety installations for protecting workers at a height, animal tethering and restraint systems, conveyor systems, guidance systems, movable supports such as clotheslines, and in any other applications where it is desirable to move a load generally along a track past local track supports.

While the above description contains many specific features, these should not be construed as limitations on the scope of the invention, but rather as an exemplification of preferred embodiments of the invention. Many other variations and adaptations to particular uses are possible, for example hoist systems, transport systems for motion-picture- and video-cameras and/or their operators, amusement park rides, shower curtains, drapes, and other guidance systems where it is desirable for something to be guided generally parallel to a versatile track. Other examples of useful adaptations can include tethering systems to constrain the movements of a mobile robot or an otherwise autonomous vehicle. Accordingly, the scope of the invention should be determined not by the embodiments illustrated, but by the appended claims and their legal equivalents.

Having described my invention, I claim:

1. Apparatus for guided transport of a load generally along a path constrained by a track, said apparatus comprising:

a track; and a) a track support supporting and locating said track, said track support having a curvilinear arm forming a sector of a circle, said circle having a radius and a center of curvature; and said track disposed at said center of curvature; and b) a track-traveling element movable along said track and pivotable about an axis parallel to said track, said track-traveling element having means for attaching said load to said track-traveling element, said track-traveling element having a periphery and a passageway, said passageway generally surrounding said track, said track-traveling element having a slot extending from said passageway through said periphery, said axis being disposed to be coincident with said center of curvature to within a tolerance, and said slot being disposed at a distance from said axis substantially equal to said radius to allow said slot to pass said curvilinear arm of said track-support as said track-traveling element is moved along said track.

2. An apparatus as in claim 1, further comprising a plurality of tracks.

3. An apparatus as in claim 1, further comprising a plurality of track supports in spaced-apart relationship, one to another along said track.

4. An apparatus as in claim 1, wherein said track-traveling element further comprises means for driving said track-traveling element along said track.

5. An apparatus as in claim 1, wherein said means for attaching said load includes a tether.

6. An apparatus as in claim 1, wherein said track support comprises:

a) a body portion;

b) a fist portion for holding said track at a position, said fist portion having a bore and said bore having a bore axis;

c) a forearm having first and second forearm ends, said forearm being attached to said fist portion at said first forearm end;

d) an elbow portion disposed at said second forearm end, said elbow portion defining an outermost portion; and e) a curved upperarm connected to said forearm at said elbow, said upperarm being formed in an arc whose outer radius equals the distance from said bore axis of said bore of said fist portion to said outermost portion of said elbow; and said curved upperarm being attached to said body portion, thus forming an armpit portion for providing clearance for said track-traveling element as it passes by said track-support.

7. An apparatus as in claim 1, wherein said track has two ends, said apparatus further comprising a pair of end supports, each supporting one of said two ends.

8. An apparatus as in claim 1, wherein said track comprises a rigid track.

9. An apparatus as in claim 3, wherein said track comprises a flexible track.

10. An apparatus as in claim 4, wherein said means for driving, comprises an electric motor attached to said track-traveling element and means for providing electrical power to said electric motor.

11. An apparatus as in claim 4, wherein said means for driving comprises a linear motor.

12. An apparatus as in claim 6, wherein said fist portion is of generally tubular form, said fist portion having a bore of diameter greater than the maximum thickness of said track.

13. An apparatus as in claim 6, wherein said fist portion of said track-support has a curvilinear form for providing a change of track direction.

14. An apparatus as in claim 9, wherein said flexible track comprises a cable.

15. An apparatus as in claim 9, wherein said flexible track is longitudinally movable through said track support, and said apparatus further comprises means for moving said flexible track.

16. An apparatus as in claim 15, wherein said means for moving said flexible track comprises an electric motor, means for providing electrical power to said electric motor, and means for coupling the output of said electric motor to said track.

17. A fall-arrest safety system for a worker, comprising an apparatus as in claim 1, wherein said track is located at a height, and said means for attaching said load includes a lanyard for attaching a safety harness worn by said worker to said track-traveling element, said lanyard having a suitable length and sufficient strength for preventing said worker from falling more than a fraction of said height.

18. A tethering system for an animal, comprising an apparatus as in claim 1, wherein said means for attaching said load includes a lanyard for attaching said animal to said track-traveling element, said lanyard having a suitable length and sufficient strength for preventing said animal from leaving a predefined area.

19. Apparatus for guided transport of a load generally along a path constrained by a track, said apparatus comprising:

a track; and a) a track support supporting and locating said track, said track support having track-locating means for locating said track and support means for supporting said track-locating means, and said support means comprising a base for securing said track support to a structure, and a curvilinear arm having a center of curvature and a circular portion, said circular portion of said curvilinear arm having a radius of curvature, said curvilinear arm serving to connect said track-locating means to said base; and said track disposed at said center of curvature; and b) a track-traveling element movable along said track, said track-traveling element having a periphery, said track-traveling element including:

i) means for attaching said load to said track-traveling element, ii) a pivotal axis, said pivotal axis being disposed for alignment with said center of curvature of said circular portion of said curvilinear arm, iii) a periphery and a passageway, said passageway being large enough to allow passage of both said track-locating means and at least a first portion of said curvilinear arm of said support means, and iv) a slot extending from said passageway through said periphery, said slot being disposed at a distance from said pivotal axis equal to said radius of curvature of said circular portion of said curvilinear arm to allow the passage of at least a second portion of said curvilinear arm of said support means as said track-traveling element is moved along said track past said track support.

20. An apparatus as in claim 19, wherein at least one of said track or said track support has a concave rounded portion centered about said center of curvature, said rounded portion having a first radius; and said passageway of said track-traveling element has a protuberance fitting into said concave rounded portion, said protuberance having a second radius no larger than said first radius for allowing rotation of said track-traveling element about said axis point when said track-traveling element is in contact with said track, whereby said slot can pass said curvilinear arm.

21. Apparatus for guided transport of a load generally along a path adjacent to a support structure, said path being constrained by a track having a track axis, said apparatus comprising:

a) a track support component including i) a first portion at least partially aligned vertically with said track axis, ii) means for attachment to said support structure, and iii) a curvilinear arm, having a center of curvature within said track; and b) a track-traveling element being pivotable about said center, having a periphery, a passageway for said track, and a slot communicating between said periphery and said passageway, said slot having a width for passing said curvilinear arm, and said slot including an arc of a circle centered on said center of curvature when said track-traveling element is disposed on said track, so that said slot passes along said curvilinear arm when said track-traveling element pivots about said center of curvature.

22. An apparatus as in claim 21, further comprising a plurality of tracks.

23. An apparatus as in claim 21, further comprising a plurality of track supports in spaced-apart relationship, one to another along said track.

24. A fall-arrest safety system for a worker, comprising an apparatus as in claim 21, wherein said track is located at a height, and said means for attaching said load includes a lanyard for attaching a safety harness worn by said worker to said track-traveling element, said lanyard having a suitable length and sufficient strength for preventing said worker from falling more than a fraction of said height.

25. A tethering system for an animal, comprising an apparatus as in claim 21, wherein said means for attaching said load includes a lanyard for attaching said animal to said track-traveling element, said lanyard having a suitable length and sufficient strength for preventing said animal from leaving a predefined area.

26. Apparatus for guided transport of a load generally along a path, said apparatus comprising:

a) a track disposed generally parallel to said path;

b) a track support for supporting and locating said track, said track support having a curvilinear arm forming a sector of a circle, said circle having a radius and a center of curvature; and said track disposed at said center of curvature; and c) a track-traveling element movable along said track and pivotable about an axis parallel to said track, said track-traveling element having means for attaching said load to said track-traveling element, said track-traveling element having a periphery and a passageway, said passageway at least partially surrounding said track, said track-traveling element having a slot extending from said passageway through said periphery, said axis being disposed to be coincident with said center of curvature to within a tolerance, and said slot being disposed at a distance from said axis substantially equal to said radius to allow said slot to pass said curvilinear arm of said track-support as said track-traveling element is moved along said track.

27. Apparatus for guided transport of a load generally along a path adjacent to a support structure, said apparatus comprising:

a) a track, said track being disposed generally parallel to said path;

b) a track support component including:

i) a first portion at least partially aligned with said track, ii) means for attachment to said support structure, and iii) a curvilinear arm, having a center of curvature aligned with respect to said track; and said track disposed at said center of curvature; and c) a track-traveling element being pivotable about said center of curvature of said curvilinear arm, said track-traveling element having a periphery, a passageway for said track, and a slot communicating between said periphery and said passageway, said slot having a width suitable for passing said curvilinear arm, and said slot including an arc of a circle centered on said center of curvature when said track-traveling element is disposed on said track, so that said slot can pass unimpeded along at least a portion of said curvilinear arm when said track-traveling element pivots about said center of curvature.

* * * * *